United States Patent [19]

Takikawa

[11] 4,145,678

[45] Mar. 20, 1979

[54] PICKUP TUBE STRUCTURE WITH AN IMPROVED MAGNETIC SHIELD

[75] Inventor: Toru Takikawa, Mobara, Japan

[73] Assignee: Hitachi, Ltd., Japan

[21] Appl. No.: 879,747

[22] Filed: Feb. 21, 1978

[30] Foreign Application Priority Data

May 9, 1977 [JP] Japan ..... 52-52029

[51] Int. Cl.[2] ..... H01F 1/00

[52] U.S. Cl. ..... 335/214; 335/211

[58] Field of Search ..... 335/210, 211, 212, 213, 335/214

[56] References Cited

U.S. PATENT DOCUMENTS

| | | | |
|---|---|---|---|
| 2,217,409 | 10/1940 | Hepp | 335/214 |
| 3,052,809 | 9/1962 | Bahring et al. | 335/214 X |
| 3,974,421 | 8/1976 | Holman | 335/214 X |

*Primary Examiner*—George Harris

*Attorney, Agent, or Firm*—Craig & Antonelli

[57] ABSTRACT

A pickup tube structure comprises an image pickup tube and a yoke assembly mounted on the pickup tube. The yoke assembly includes a magnetic shield in a specific arrangement with respect to the axis of the pickup tube, as well as beam focusing and deflecting coils. The shield is shaped in a cylindrical form with an almost linear joint portion placed in parallel with the tube axis. The angle between the plane including the joint portion and the tube axis and the plane including the direction of the magnetic field for the beam horizontal deflection and the tube axis is not smaller than about −30° and is not larger than about +30°.

2 Claims, 4 Drawing Figures

PICKUP TUBE STRUCTURE WITH AN IMPROVED MAGNETIC SHIELD

LIST OF PRIOR ART REFERENCES

The following references are cited to show the state of the art:

*The Journal of the Institute of Television Engineers of Japan* Vol. 28 No. 11 (Oct., 1974) pp. 930–934.

This invention relates to an image pickup tube structure with an improved magnetic shield means.

In order to operate an image pickup tube, an electron beam is required to be focused and deflected. For performing such focusing and deflecting operations magnetically, a yoke assembly including focusing and deflecting coils is used. In a television pickup tube, an excellent image of an object cannot be reproduced faithfully unless the electron beam in the pickup tube is controlled exclusively by the magnetic field of the yoke assembly without being adversely affected by an external magnetic field. For this purpose, the yoke assembly is normally surrounded by a magnetic shield means made of a high magnetic permeability material such as permalloy to shield the yoke assembly from an external magnetic field. For a multi-tube color pickup device, the magnetic shield is particularly important in view of the fact that relative differences in geometric distortion of images picked up by respective tubes result in registration fault or color degradation. The multi-tube color pickup device, therefore, usually employs a magnetic shield means of permalloy 0.8 to 1.0 mm thick. The high permeability material such as permalloy is generally low in workability, and therefore the magnetic shield means is generally shaped in a cylindrical form by rounding and welding a flat plate. Such a permalloy shield with a joint portion, even if sufficiently annealed, unavoidably lacks uniformity of permeability at the joint portion. Thus, the conventional image pickup tube device including an image pickup tube on which a yoke assembly with such a cylindrical shield is mounted usually undergoes geometric image distortion.

Accordingly, it is an object of the present invention to provide an image pickup tube structure in which the geometric image distortion is reduced.

According to the present invention, there is provided a pickup tube structure comprising an image pickup tube and a yoke assembly mounted on the image pickup tube, the image pickup tube including beam producing means, the yoke assembly including beam focusing and deflecting means and a magnetic shield means for suppressing undesirable effect of external magnetic field on the electron beam within the tube, the magnetic shield means being made of a plate of a high permeability material shaped in a cylindrical form with an almost linear joint portion, in which the direction of the linear joint portion of the cylindrical shield means is almost parallel with the axis of the image pickup tube and the angle between the plane including the linear joint portion of the cylindrical shield means and the axis of the image pickup tube and the plane including the direction of the magnetic field for the horizontal deflection of the electron beam and the axis of the image pickup tube is not smaller than about $-30°$ and is not larger than about $+30°$.

The invention will now be described by way of example with reference to the accompanying drawings, in which.

Figure 1:
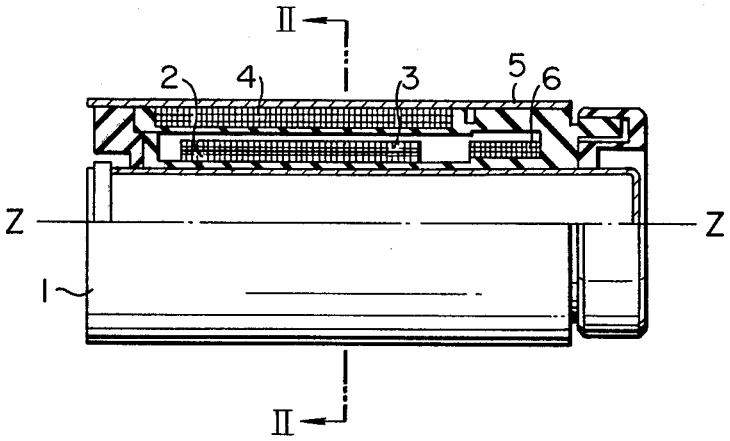
FIG. 1 is a side view, partly in section, of an image pickup tube structure.
Figure 2:
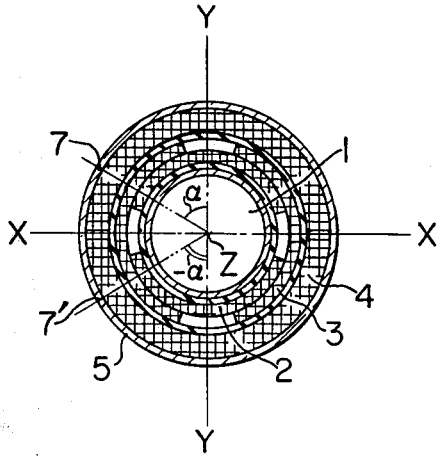
FIG. 2 is a cross-sectional view taken along line II—II in FIG. 1.

In FIGS. 1 and 2, horizontal and vertical deflection coils 2 and 3 are located around an image pickup tube 1. Further, around the deflection coils, a focusing coil 4, being insulated from them, is provided. Reference numeral 5 shows a cylindrical magnetic shield including a substantially linear joint portion 7. In order that an electron beam emitted from an electron gun (not shown) placed in position within the image pickup tube 1 may not be adversely affected by an external magnetic field, the cylindrical magnetic shield 5 is provided outside of and around the focusing coil 4. The magnetic shield 5 is made of a high permeability material such as permalloy. In this specification, the yoke assembly means an assembly including the deflection coils 2 and 3, the focusing coil 4 and the magnetic shield 5. Numeral 6 shows an alignment coil. The internal structure of the pickup tube has no direct relation with the gist of the present invention and therefore is not shown in the drawings. Line Z—Z designates an axis representing the center line of the pickup tube 1. Line Y—Y represents the direction of the horizontal deflection magnetic field in the pickup tube 1, and line X—X the direction perpendicular to line Y—Y as viewed in the plane of FIG. 2.

In view of the above-mentioned disadvantages, the inventor has studied the relation between the geometric image distortion attributable to the yoke assembly and the linear joint portion of the cylindrical shield, and found that by locating the linear joint portion of the cylindrical shield in parallel to the center axis of the image pickup tube at a particular angular position with respect to center axis of the pickup tube, the geometric image distortion is minimized.

Figure 3:
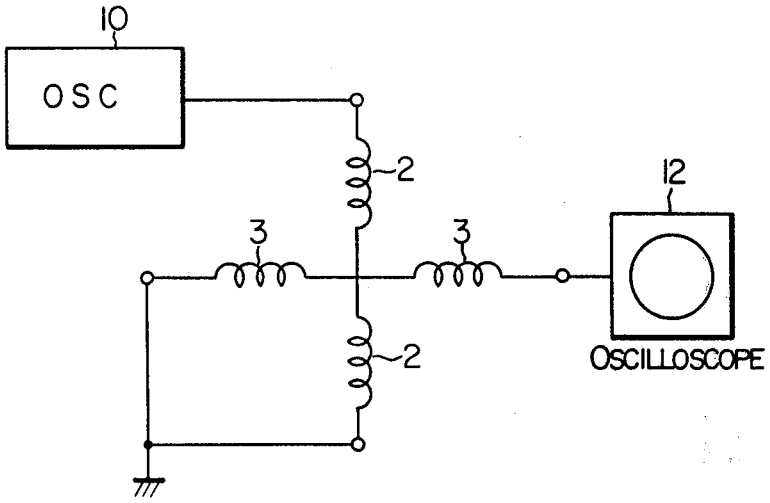
FIG. 3 is a diagram showing a circuit for measuring coupling between horizontal and vertical deflection coils.

A circuit for electrically and quantitatively measuring coupling between horizontal and vertical deflection coils in the yoke assembly is shown in FIG. 3. AC current at a frequency within a range from 1 to 16 KHz (e.g., 16 KHz) is supplied from an oscillator 10 to the horizontal deflection coil 2, so that an electromotive force appearing in the vertical deflection coil 3 with its center axis placed perpendicular to that of the horizontal deflection coil 2 is measured by an oscilloscope 12. In other words, by measuring the quantity of the crosstalk from the horizontal deflection coil 2 to the vertical deflection coil 3, the tendency or the amount of geometric image distortion is deduced. If the yoke assembly is arranged in position as intended, the amount of that part of magnetic flux generated by the AC current flow in the horizontal deflection coil 2 which interlinks with the vertical deflection coil 3 will be zero, with the result that no electromotive force would be induced in the vertical deflection coil 3. In the event that the magnetic field generated by the horizontal deflection coil 2 is distorted because of the fact that some part of the magnetic shield is different in permeability from the remainder thereof, the amount of that part of the magnetic flux generated by the horizontal deflection coil 2 which interlinks with the vertical deflection coil may not be zero, depending on the relative position of that particular part of the magnetic shield with respect to the deflection coils. In such a case, the horizontal and vertical deflection coils are coupled to each other through the magnetic shield, thereby causing a geometrical image distortion proportionate to the degree of the coupling between the coils 2 and 3.

Figure 4:
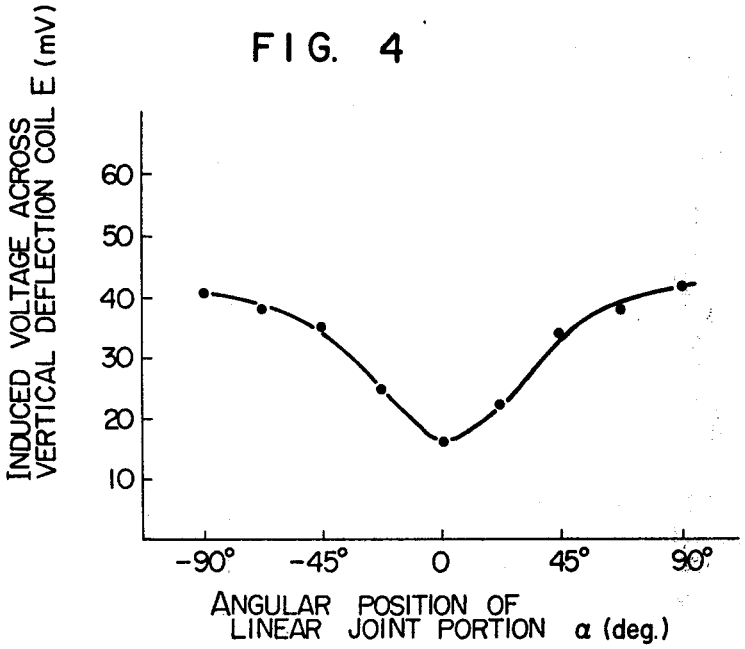
FIG. 4 is a diagram showing the results of measuring the relation between the angular position of the magnetic shield and the crosstalk between the horizontal and vertical coils by the use of the measuring circuit of FIG. 3.

The diagram of FIG. 4 shows the crosstalk between the deflection coils 2 and 3 by means of the measuring circuit of FIG. 3. In this drawing, the abscissa represents the angle between the plane including the direction of the beam horizontal deflection magnetic field and the axis Z—Z of the pickup tube 1 and the plane including the linear joint portion 7 or 7' of the cylindrical shield 5 and the axis Z—Z of the pickup tube 1, i.e., the angular position $\alpha$ (in degrees) of the linear joint portion 7 or 7' (see FIGS. 1 and 2), while the ordinate represents the electromotive force E (mV) induced in the vertical deflection coil 3 upon application of an AC voltage 2 V at 16 KHz to the horizontal deflection coil 2. The magnetic shield is made of permalloy. As illustrated in the drawing under consideration, the electromotive force induced in the vertical deflection coil 3 or crosstalk becomes minimum when the angular position of the linear joint portion 7 of the cylindrical shield 5 is 0°, that is, when the shield 5 is so arranged as having the direction of the joint portion 7 coincide with that of the magnetic field for horizontal deflection. In order to reduce the registration fault in a multitube color pickup device to a virtually negligibly small level, the amount of crosstalk is required to be not larger than −36 dB. Therefore, $$-36 \geqq 20 \log (E/2) \therefore E \lesssim 32 \text{ (mV)}$$

Thus, the angular position of the linear joint portion of the cylindrical shield is required to be at an angle not smaller than approximately −30° and not larger than approximately +30°.

As will be understood from the foregoing description, the present invention is such that even when the magnetic shield of the yoke assembly for the image pickup tube is made by rounding a plate of a material such as permalloy high in magnetic permeability and low in workability, the geometric image distortion is reduced to considerably reduce the color degradation in a multi-tube color pickup device.

What is claimed is:

1. A pickup tube structure comprising an image pickup tube and a yoke assembly mounted on the image pickup tube, the image pickup tube including beam producing means, the yoke assembly including beam focusing and deflecting means and a magnetic shield means for suppressing undesirable effect of external magnetic field on the electron beam within the tube, the magnetic shield means being made of a plate of a high permeability material shaped in a cylindrical form with an almost linear joint portion, in which the direction of the linear joint portion of the cylindrical shield means is almost parallel with the axis of the image pickup tube and the angle between the plane including the linear joint portion of the cylindrical shield means and the axis of the image pickup tube and the plane including the direction of the magnetic field for the horizontal deflection of the electron beam and the axis of the image pickup tube is not smaller than about −30° and is not larger than about +30°.

2. A pickup tube structure according to claim 1, in which the magnetic shield is made of a permalloy.

* * * * *